US006413691B2

(12) United States Patent
Daimon et al.

(10) Patent No.: US 6,413,691 B2
(45) Date of Patent: Jul. 2, 2002

(54) ELECTROPHOTOGRAPHIC TONER, PROCESS FOR PRODUCING THE SAME, ELECTROPHOTOGRAPHIC DEVELOPER, AND PROCESS FOR FORMING IMAGE

(75) Inventors: Katsumi Daimon; Masato Mikami; Norihito Fukushima; Chisato Urano; Takashi Imai; Jun Igarashi, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/818,620

(22) Filed: Mar. 28, 2001

(30) Foreign Application Priority Data

Apr. 20, 2000 (JP) ..... 2000-119154

(51) Int. Cl.[7] ..... G03G 9/087

(52) U.S. Cl. ..... 430/109.4; 430/111.4; 430/124; 430/126; 430/137.14

(58) Field of Search ..... 430/109.4, 111.4, 430/108.5, 137.14, 124, 126

(56) References Cited

U.S. PATENT DOCUMENTS

| | | | | |
|---|---|---|---|---|
| 4,990,424 A | | 2/1991 | Van Dusen et al. | 525/165 |
| 5,021,316 A | * | 6/1991 | Kubo et al. | 430/111.1 |
| 5,348,832 A | * | 9/1994 | Sacripante et al. | 430/109.4 |
| 5,593,807 A | | 1/1997 | Sacripante et al. | 523/335 |
| 5,660,965 A | | 8/1997 | Mychajlowskij et al. | 523/335 |

FOREIGN PATENT DOCUMENTS

| | | |
|---|---|---|
| JP | 36-10231 | 7/1961 |
| JP | 42-23910 | 11/1967 |
| JP | 50-134652 A | 10/1975 |
| JP | 51-23354 B2 | 7/1976 |
| JP | 1-163756 A | 6/1989 |
| JP | 1-163757 A | 6/1989 |
| JP | 2-79860 A | 3/1990 |
| JP | 4-81770 A | 3/1992 |
| JP | 4-24702 B2 | 4/1992 |
| JP | 4-24703 B2 | 4/1992 |
| JP | 4-155351 A | 5/1992 |
| JP | 5-44032 B2 | 7/1993 |
| JP | 9-329917 A | 12/1997 |
| JP | 10-39545 A | 2/1998 |
| JP | 10-48890 | 2/1998 |

* cited by examiner

*Primary Examiner*—Janis L. Dote
(74) *Attorney, Agent, or Firm*—Oliff & Berridge, PLC

(57) ABSTRACT

An electrophotographic toner excellent in dispersibility of a colorant, excellent in fixing property at a low temperature and having a broad fixing latitude of good offset resisting property, and a process for producing the same, as well as an electrophotographic developer and a process for forming an image using the electrophotographic toner are provided. The electrophotographic toner is provided that contains a binder resin and a colorant, in which the binder resin contains a crystalline polyester containing a carboxylic acid of two or more valences having a sulfonic acid group as a monomer component, and a process for producing the same, as well as an electrophotographic developer and a process for forming an image using the electrophotographic toner are provided.

18 Claims, 1 Drawing Sheet

ELECTROPHOTOGRAPHIC TONER, PROCESS FOR PRODUCING THE SAME, ELECTROPHOTOGRAPHIC DEVELOPER, AND PROCESS FOR FORMING IMAGE

FIELD OF THE INVENTION

The present invention relates to an electrophotographic toner and a process for producing the same that can be applied to an electrophotographic apparatus utilizing an electrophotographic process, such as a duplicator, a printer and a facsimile machine, as well as an electrophotographic developer and a process for forming an image.

BACKGROUND OF THE INVENTION

As an electrophotographic process, large number of processes have been known as described in JP-B-42-23910. In general, a fixed image is formed through plural steps in that a latent image is electrically formed on a photoreceptor utilizing a photoconductive substance by various methods, the latent image thus formed is developed with a toner to form a toner image, the toner image on the photoreceptor is transferred to a transfer material such as paper through or not through an intermediate transfer material, and the transferred image is fixed by applying heat, pressure, heat and pressure, or solvent vapor. The photoreceptor is subjected to cleaning of the toner remaining on the surface thereof by various methods depending on necessity and then is again subjected to the plural steps.

As a fixing technique for fixing a transfer image transferred to a transfer material, a heat roll fixing process is generally used, in which a transfer material having a toner image transferred thereon is put through a pair of rolls consisting of a heating roll and a pressure roll. Processes where one or both of the rolls are replaced by a belt are also known as the similar process.

In these processes, a firm fixed image can be quickly obtained with high energy efficiency, and less pollution of environments due to solvents is caused, in comparison to other fixing processes. However, because the toner image is in direct contact with the roll or the belt, offset is liable to occur, in which a part of the toner is attached to the roll or the belt at the fixing time. Particularly, in the case where the temperature of the fixing device is high, offset is liable to occur since the aggregation force of the molten toner is lowered.

On the other hand, a technique where fixing is conducted at a lower temperature is demanded to reduce the consumed energy amount, and in recent years, it is demanded to terminate electricity to the fixing device except for operation to ensure energy saving. Therefore, it is necessary that the temperature of the fixing device be instantaneously increased to the working temperature upon application of electricity. For that purpose, it is desired to reduce the heat capacity of the fixing device as possible, but in that case, there is a tendency that the fluctuation width of the temperature of the fixing device becomes larger than the conventional one. That is, the overshoot of the temperature after application of electricity is increased, and the temperature drop due to insertion of paper is also increased. Furthermore, in the case where paper having a size smaller than the width of the fixing device is continuously inserted, the temperature difference between the part where the paper is in contact therewith and the part where the paper is not in contact becomes large. Particularly, in the case where the fixing device is used in a high-speed duplicator or printer, such a phenomenon is liable to occur because the capacity of the power source is liable to be short.

Therefore, an electrophotographic toner that can be fixed at a low temperature but does not cause offset in a high temperature range, i.e., that has a broad fixing latitude, is strongly demanded.

As a method for decreasing the fixing temperature of the toner, it has been known to use a crystalline resin as a binder resin constituting the toner (as described in JP-B-4-24702, JP-B-4-24703 and JP-A-9-329917). The crystalline resin cannot be generally used because it is difficult to pulverize by a melt-kneading pulverization process, and even when it is used, the fixing temperature can be decreased, but the sufficient offset resistance cannot be always obtained. That is, the molten toner penetrates into the paper to exhibit the effect of preventing the occurrence of offset, but such a problem is caused that the molten toner excessively penetrates into the paper, so as to fail to obtain a uniform image with high density.

On the other hand, as a method for preventing offset, it has been known to use a resin having a suitable molecular weight distribution that is obtained by blending a low molecular weight polymer and a high molecular weight polymer (as described in JP-A-50-134652), and also known to use a crosslinked polymer (described in JP-B-51-23354).

However, the sufficiently broad fixing latitude described in the foregoing cannot be ensured.

When a large amount of the high molecular weight polymer or the crosslinked polymer is used as described in the foregoing, offset is difficult to occur, but the fixing temperature is increased. On the other hand, when the molecular weight of the low molecular weight polymer is decreased, or the amount thereof is increased to decrease the fixing temperature, the temperature, at which offset occurs, is lowered. While the fixing temperature can be decreased by decreasing the glass transition temperature of the binder resin used or by using a plasticizer, the blocking phenomenon occurs, in which the toner is aggregated and solidified upon storage or in the fixing device.

As a method for solving the problems, various techniques have been proposed in that a crystalline resin is not used singly as the binder resin but an amorphous resin is used in combination.

In the case where the toner is produced by the melt kneading pulverization process, it has been known that pulverization becomes easy by the presence of an amorphous component. For example, JP-A-2-79860 discloses a technique using a crystalline resin and an amorphous resin in combination, and JP-A-1-163756, JP-A-1-163757, JP-A-4-81770, JP-A-155351 and JP-B-5-44032 disclose a technique using a polymer formed by chemically bonding a crystalline resin and an amorphous resin.

However, in the case where the amount of the amorphous resin is larger than the crystalline resin, the amorphous resin forms a continuous phase, and the crystalline resin forms a dispersed phase. In this case, since the crystalline resin is covered with the amorphous resin, the problem due to the crystalline resin does not occur, but since the melting behavior of the entire toner controlled by the softening temperature of the amorphous resin, it becomes difficult to realize the low temperature fixing property. On the contrary, in the case where the amount of the crystalline resin is larger than the amorphous resin, the effect of the combination of the amorphous resin cannot be sufficiently obtained.

As has been described, in order to improve the low temperature fixing property and the offset resisting property, the melt kneading pulverization process involves difficulties in that the binder resin that is effective to the low temperature fixing property and the offset resisting property is difficult to be used, and the use of the polymer having a high molecular weight or the crosslinked structure cannot provide sufficient performance. Furthermore, it is difficult to be pulverized, and thus the particle diameter of the toner is difficult to be reduced for realizing high image quality. While a polyester resin is generally used in the melt kneading pulverization process, it is difficult to be formed in to a spherical form since it is once melted and then subjected to polycondensation.

In order to reduce the amount of the non-transferred toner remaining on a photoreceptor after transfer for electric power saving, it is preferred that the toner particles are formed into a spherical form.

As a process for producing a toner for solving the problems, a wet production process, such as a particle production process by polymerization including the suspension polymerization process described in JP-B-36-10231, has been proposed.

According to the suspension polymerization process as the wet production process, the shape of the toner particles can be controlled to easily produce toner particles that are difficult to be kneaded and pulverized, and the particle size distribution can be controlled in the step of production of the particles. Therefore, the classification step is not necessarily provided, which has been necessary in the melt kneading pulverization process to make the particles uniform.

However, in the suspension polymerization process using a crystalline resin, a colorant is difficult to be dispersed in the toner, and thus a toner having a colorant suitably dispersed therein often cannot be obtained. When the colorant is aggregated in the toner, light scattering becomes conspicuous to cause problems in that the transparency and the coloration are poor.

A process for producing toner particles by the wet production process is disclosed in JP-A-10-39545 and JP-A-10-48890, in which an emulsified latex containing a sodium sulfonated polyester and a pigment dispersion are mixed with applying a shearing force, to which a halogenated alkyl is added thereto, followed by heating, and then the mixture is aggregated to cause unification, so as to produce toner particles. According to the process, while the dispersion state of the pigment can be maintained good, the fixing temperature has to be high from the standpoint of practical use.

As described in the foregoing, in order to simultaneously decrease the fixing temperature and prevent the occurrence of offset, contradict characteristics are demanded as the properties of the electrophotographic toner.

Therefore, an electrophotographic toner having a broad fixing latitude that can be fixed at a low temperature and does not cause offset in a higher temperature range have not yet been provided at the present time. Furthermore, an electrophotographic toner having a broad fixing latitude that provide the low temperature fixing property and an excellent in offset property, and exhibits good pigment dispersion has not yet been provided.

SUMMARY OF THE INVENTION

The invention has been made to solve the problems associated with the conventional techniques and to provide an electrophotographic toner that is excellent in dispersion property of a colorant and excellent in fixing property at a low temperature.

The invention has also been made to provide an electrophotographic toner having a broad fixing latitude that is good in offset resisting property.

The invention has also been made to provide a process for producing an electrophotographic toner, by which the electrophotographic toner having the excellent properties, particularly an electrophotographic toner having a spherical form.

The invention has also been made to provide an electrophotographic developer and a process for forming an image using the electrophotographic toner having the excellent properties.

As a result of earnest investigations made by the inventors to solve the problems, the following findings have been obtained, and the invention has been accomplished.

(1) When a crystalline polyester containing a carboxylic acid of two or more valences having a sulfonic acid group as a copolymerization component is used as a main component of binder resin, the dispersion property of a colorant upon production process of a toner is excellent, and a uniform toner can be produced.

(2) In order to improve the offset resisting property in a broad range of temperature with maintaining the low temperature fixing property, a crystalline resin is useful, and in order to avoid the known problem associated with the crystalline resin, i.e., excessive penetration into paper, without affecting other characteristics, it is useful to use a crosslink type crystalline resin having an unsaturated double bond as the binder resin, by which a crosslinked structure can be introduced in the production process of the toner.

(3) According to a process, in which a sodium sulfonated crystalline polyester is formed into an emulsified latex, and the latex is aggregated and unionized (unified) to produce toner particles, both the low temperature fixing property and the offset resisting property can be improved, and the dispersion property of the colorant is good, so as to produce toner particles.

According to an aspect of the invention, the electrophotographic toner contains at least a binder resin and a colorant, the binder resin containing a crystalline polyester containing a carboxylic acid of two or more valences having a sulfonic acid group as a copolymerization component.

In the invention, it is preferred that the crystalline polyester containing a carboxylic acid of two or more valences having a sulfonic acid group as a copolymerization component is crosslinked by a chemical bond, and it is more preferred that it is crosslinked by a radical chemical bond through an unsaturated bond group.

The electrophotographic toner of the invention preferably has, at an angular frequency of 1 rad/sec and a temperature of 30° C., a storage modulus $G_L(30)$ of $1\times10^6$ Pa or more and a loss modulus $G_N(30)$ of $1\times10^6$ Pa or more, and preferably has a melting point in a temperature range of from 45 to 110° C.

When common logarithm of a storage modulus is plotted against a temperature, the electrophotographic toner of the invention preferably satisfies the following formula (1):

$$|\log G_L(Tm+20)-\log G_L(Tm+50)|\leqq 1.5 \quad (1)$$

wherein $G_L(Tm+20)$ is a storage modulus at a temperature (Tm+20° C.) higher than a melting point Tm by 20° C., and $G_L(Tm+50)$ is a storage modulus at a temperature (Tm+50° C.) higher than a melting point Tm by 50° C.

According to another aspect of the invention, the process for producing an electrophotographic toner produces the electrophotographic toner of the invention, and the process contains a step of emulsifying a crystalline polyester containing a carboxylic acid of two or more valences containing a sulfonic acid group as a copolymerization component, and a step of aggregating and unifying the same to adjust a diameter of the toner.

According to a further aspect of the invention, the electrophotographic developer contains a carrier and a toner, the toner being the electrophotographic toner of the invention.

According to a still further aspect of the invention, the process for forming an image contains a latent image forming step of forming an electrostatic latent image on a surface of a latent image holding member, a developing step of developing the electrostatic latent image formed on the surface of the latent image holding member with a developer retained on a developer holding member to form a toner image, a transferring step of transferring the toner image formed on the surface of the latent image holding member to a surface of a transfer material, and a fixing step of heat fixing the toner image transferred to the transfer material, the developer being the electrophotographic toner of the invention or the developer of the invention.

DETAILED DESCRIPTION OF THE INVENTION

Figure 1:
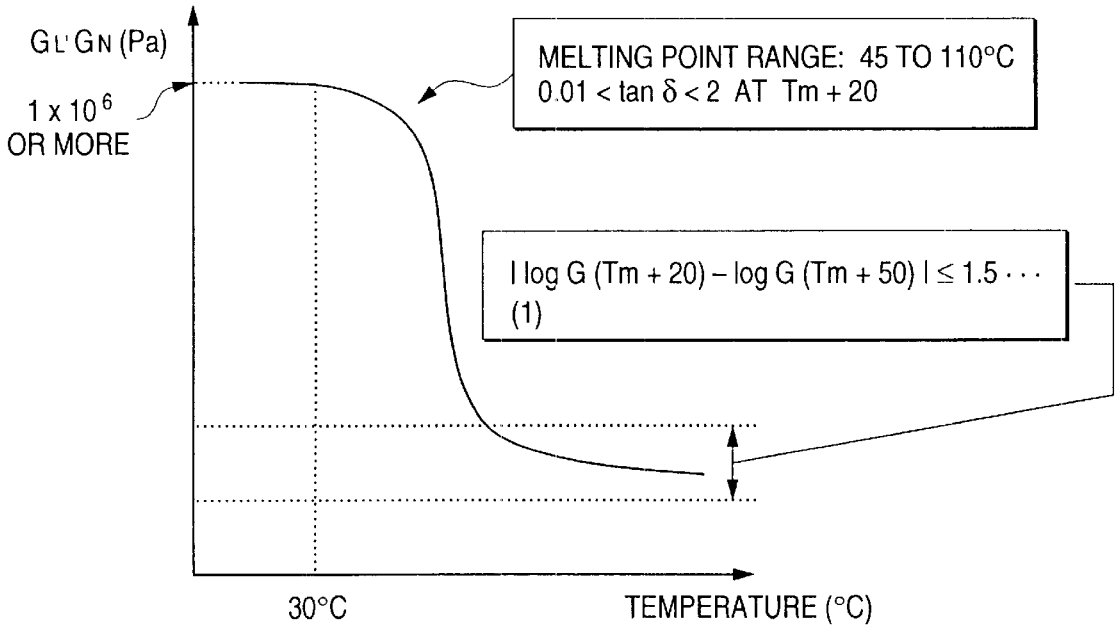
FIG. 1 is a graph showing preferred characteristics of the electrophotographic toner of the invention, in which the ordinate indicates the common logarithm of storage modulus $\log G_L$ or the common logarithm of loss modulus $\log G_N$, and the abscissa indicates the temperature.

The invention will be described in detail below for the electrophotographic toner, the process for producing the same, the electrophotographic developer and the process for forming an image according to the invention, respectively.

Electrophotographic Toner

The electrophotographic toner of the invention contains at least a binder resin and a colorant, characterized in that the binder resin contains a crystalline polyester containing a carboxylic acid of two or more valences containing a sulfonic acid group as a copolycondensation component, and may contain other component depending on necessity.

Binder Resin

In the electrophotographic toner of the invention (hereinafter sometimes simply referred to as a "toner"), the binder resin contains a crystalline polyester containing a carboxylic acid of two or more valences containing a sulfonic acid group as a copolycondensation component. In the case where the crystalline polyester containing a carboxylic acid of two or more valences containing a sulfonic acid group as a copolycondensation component (hereinafter sometimes abbreviated as a "crystalline sulfonated polyester") is used as the binder resin, when the binder resin is dissolved in a solvent and a colorant is dispersed upon production of the toner, the dispersion property of the colorant becomes good, and a uniform electrophotographic toner can be obtained. The electrophotographic toner is also excellent in fixing property at a low temperature.

The carboxylic acid of two or more valences having a sulfonic acid group is not particularly limited. It necessarily has two or more valences, preferably three or less valences, and more preferably two valences. The carboxylic acid of two or more valences having a sulfonic acid group may be an alkyl ester or an anhydride. The sulfonic acid group may be in the form of a salt by combining with a metallic ion.

Preferred examples of the carboxylic acid of two valences having a sulfonic acid group include those having the structure represented by the following general formula (1):

$$A(SO_3^-X^+)_nZ_2 \quad (I)$$

In the general formula (I), A represents a hydrocarbon atomic group having a linear form, a branched form, a cyclic form or a mixed form thereof, X represents a monovalent cation or a multivalent cation, wherein the monovalent cation may be selected from the group consisting of $H^+$, $Na^+$, $K^+$and $Li^+$and the multivalent cation may be selected from the group comprising $Mg^{2+}$, $Ca^{2+}$, $Sr^{2+}$, $Ba^{2+}$, Fe cation, Co cation, Ni cation, Cu cation, Zn cation and Al cation, Z represents a carboxyl group, and n represents an integer of from 1 to 3. The carboxyl group represented by Z in the general formula (I) may be esterified to form an alkyl ester, and may be an anhydride by dehydrating the carboxyl groups represented by Z to form a ring.

Examples of the hydrocarbon atomic group represented by A in the general formula (I) include an arylene group having from 6 to 24, preferably from 6 to 12, carbon atoms and a linear or branched alkylene group having from 1 to 20, preferably from 2 to 10, carbon atoms, and in an accurate meaning, n of hydrogen atoms contained therein is substituted by $(SO_3^-X^+)$. The number n in the general formula (I) is preferably an integer of 1 or 2.

Specific examples of the carboxylic acid of two or more valences having a sulfonic acid group include sodium 2-sulfoterephthalate, sodium 5-sulfoisophthalate, sodium sulfosuccinate, an anhydride thereof and a lower alkyl ester thereof.

The carboxylic acid component of two or more valence having sulfonic acid is contained in an amount of from 1 to 15 mol %, and preferably from 2 to 10 mol %, based on the total carboxylic acid component constituting the polyester. When the content is too small, the emulsified particle diameter becomes large, and the adjustment of toner diameter by aggregation becomes difficult. When the content is too large, the emulsified particle diameter becomes too small, and there are cases where the polymer is dissolved in water to fail to form latex.

The crystalline sulfonated polyester preferably contains an unsaturated double bond. That is, upon producing the toner, a crystalline polyester containing a sulfonic acid group, having an unsaturated double bond to be an unsaturated part, and can form a crosslinked structure by a crosslinking reaction (hereinafter sometimes referred to as an "unsaturated crystalline sulfonated polyester") is preferably used as the binder resin component.

The unsaturated crystalline sulfonated polyester is preferably crosslinked by a chemical bond, and is more preferably crosslinked by a radical chemical bond through the unsaturated double bond group. That is, it is preferred that the crosslinking reaction is caused at the position of the unsaturated part of the unsaturated crystalline sulfonated polyester, whereby the crystalline polyester having the crosslinked structure is present in the thus formed toner particles. The toner particles thus produced contain, as the binder resin, the crystalline polyester containing a sulfonic acid group and having a crosslinked structure by the unsaturated part (unsaturated bond) (hereinafter sometimes referred to as a "crosslinking type crystalline sulfonated polyester"). The crosslinked structure is given to the crystalline polyester, whereby an electrophotographic toner good in offset resisting property having a broad fixing latitude can be provided.

It is preferred in the production process of the toner that the emulsified particles are produced by utilizing the sulfonic acid group, and then aggregated, followed by formed into particles by heating. The production of the toner will be described later.

The crosslinking type crystalline sulfonated polyester is a crystalline resin having a crosslinked structure and has such a property that it is not dissolved but swollen in an organic solvent. As has been described, when a crystalline resin is used, the good low temperature fixing property and the good offset resisting property are obtained, but excessive penetration into the transfer material, such as paper, to cause a tendency that the density of the image is difficult to be increased. When the unsaturated part having a crosslinking property is provided in the molecular structure of the binder resin, and upon forming the toner, the unsaturated part is contained in the particles of the toner, the excessive penetration into the transfer material, such as paper, can be prevented.

The crosslinking type crystalline sulfonated polyester can be obtained by conducting a condensation reaction of a mixed system of the carboxylic acid of two or more valences having a sulfonic acid group, an unsaturated carboxylic acid of two valences or three or more valences having an unsaturated part of an unsaturated double bond, and a saturated carboxylic acid of two valences or three or more valences, with an alcohol of two valences or three or more valences. As the crosslinking type crystalline sulfonated polyester is not particularly limited, a commercially available product may be used, and a suitably synthesized product may also be used.

Examples of the divalent (two valences) unsaturated carboxylic acid include maleic acid, maleic anhydride, fumaric acid, citraconic acid and itaconic acid.

Examples of the unsaturated carboxylic acid of three or more valences include aconitic acid.

The unsaturated carboxylic acid of two valences or three or more valences may be used singly or in combination of two or more kinds.

The carboxylic acid component having an unsaturated group is preferably contained in an amount of from 1 to 15 mol %, and more preferably from 3 to 10 mol %, based on the entire carboxylic acid component constituting the polyester. When the content is too small, the crosslinking reaction is difficult to proceed, and the adjustment of viscoelasticity becomes difficult. When it is too large, the crystallinity is inhibited, which brings about decrease of the melting point, and the sharp change of the viscoelasticity depending on the temperature is not exhibited.

Examples of the divalent (two valences) saturated carboxylic acid include a dibasic acid, such as oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, an anhydride thereof, and a lower alkyl ester thereof.

Examples of the saturated carboxylic acid of three or more valences include 1,2,4-benzene-tricarboxylic acid, 1,2,5-benzene-tricarboxylic acid, 1,2,4-naphthalene-tricarboxylic acid, an anhydride thereof, and a lower alkyl ester thereof.

The saturated carboxylic acid of two valences or three or more valences may be used singly or in combination of two or more of them.

Examples of the divalent (two valences) alcohol include bisphenol A, hydrogenated bisphenol A, an ethylene oxide and/or propylene oxide adduct of bisphenol A, 1,4-cyclohexanediol, 1,4-cyclohexanedimethanol, ethylene glycol, diethyelne glycol, propylene glycol, dipropylene glycol, 1,3-butanediol, 1,4-butanediol, 1,5-pentanediol, 1,6-hexanediol, neopentyl glycol and xylylene glycol.

Examples of the alcohol of three or more valences include glycerin, trimethylolpropane and pentaerythritol.

The alcohol of two valences or three or more valences may be used singly or in combination of two or more of them.

The addition amount of the alcohol of two valences or three or more valences may be such an amount that sufficient to esterify the entire carboxylic acid component, and may be excessive.

In order to adjust the acid value or the hydroxyl group value, a monovalent acid, such as acetic acid and benzoic acid, and a monovalent alcohol, such as cyclohexanol and benzyl alcohol, may be used depending on necessity.

In the invention, one kind or two or more kinds of the crystalline sulfonated polyesters are used as the binder resin as described in the foregoing, but the entire binder resin is not necessarily the polyester having a sulfonic acid group or an unsaturated bond, and an other non-crosslinked resin (hereinafter sometimes referred to as an "other monomer") may be mixed to be used as the binder resin.

As the other monomer, those suitably selected from the known non-crosslinking monomers may be used. Specific examples thereof include the divalent alcohols and the divalent carboxylic acids described hereinabove.

The content of the crystalline sulfonated polyester is preferably from 50 to 99 parts by weight, and more preferably from 70 to 99 parts by weight, per 100 parts by weight of the electrophotographic toner.

In the case where the crystalline sulfonated polyester is used with the other monomer mixed therewith, the proportion of the crystalline sulfonated polyester is preferably from 50 to 100% by weight, and more preferably from 70 to 100% by weight, based on the total amount of the binder resin in the toner. When the proportion is less than 50% by weight, there are cases where the low temperature fixing property and the broad fixing latitude cannot be ensured.

Colorant

The colorant used in the electrophotographic toner of the invention is not particularly limited and can be suitably selected from the known colorants depending on necessity. Specific examples of the colorant used in the toner of the invention include various pigments, such as carbon black, chrome yellow, Hansa Yellow, Benzidine Yellow, Suren Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Carcoil Blue, Methylene Blue Chloride, Phthalocyanine Blue, Phthalocyanine Green and Malachite Green Oxalate; and various dyes, such as acridine series, xanthene series, azo series, benzoquinone series, azine series, anthraquinone series, thioindigo series, dioxadine series, thiazine series, azomethine series, indigo series, thioindigo series, phthalocyanine series, aniline black series, polymethine series, triphenylmethane series, diphenylmethane series, thiazine series, thiazole series and xanthene series, which may be used singly or in combination of plural kinds.

As a dispersing method of the colorant, an arbitrary method, for example, a general dispersing method, such as a rotation shearing type homogenizer, a ball mill, a sand mill and a Dyeno mill using media, can be used without any limitation.

The colorant may be added to the mixed solvent at a time along with the other fine particle components, or in alternative may be divided and added by plural steps.

The content of the colorant in the electrophotographic toner of the invention is preferably from 1 to 30 parts by weight per 100 parts by weight of the binder resin, and is preferably as much as possible unless the smoothness of the surface of the image after fixing deteriorated. When the content of the colorant is large, the thickness of the image can be thinner to obtain an image of the same density, and thus it is advantageous from the standpoint of preventing offset.

In the invention, the colorant forms aggregates having a toner particle diameter along with the emulsified particles of the sulfonated polyester.

It is effective to use a colorant having been subjected to a surface treatment and a pigment dispersant depending on necessity.

A yellow toner, a magenta toner, a cyan toner and a black toner can be obtained by suitably selecting the species of the colorants.

Other Component

The other components contained in the toner of the invention are not particularly limited and can be suitably selected depending on necessity, and examples thereof include known various additives, such as inorganic fine particles, organic fine particles, a charge controlling agent and a releasing agent.

Examples of the inorganic fine particles include silica, alumina, titanium oxide, barium titanate, magnesium titanate, calcium titanate, strontium titanate, zinc oxide, silica sand, clay, mica, wollastonite, diatom earth, cerium chloride, red iron oxide, chromium oxide, cerium oxide, antimony trioxide, magnesium oxide, zirconium oxide, silicon carbide and silicon nitride. Among these, silica fine particles are preferred, and silica fine particles having been subjected to a hydrophobic treatment are particularly preferred.

The inorganic fine particles are generally used for improving the fluidity. The primary particle diameter of the inorganic fine particles is preferably from 1 to 1,000 nm, and the addition amount thereof is preferably from 0.01 to 20 parts by weight per 100 parts by weight of the toner.

The organic fine particles are generally used for improving the cleaning property and the transferring property, and specific examples thereof include polystyrene, polymethyl methacrylate and polyvinylidene fluoride.

The charge controlling agent is generally used for improving the charging property, and specific examples thereof include a metallic salt of salicylic acid, a metal-containing azo compound, nigrosine and a quaternary ammonium salt.

The releasing agent is generally used for improving the releasing property, and specific examples thereof include paraffin wax, such as low molecular weight polypropylene and low molecular weight polyethylene, polyester wax, a silicone resin, rosin, rice wax and carnauba wax.

Other Constitution

In the electrophotographic toner of the invention, the surface thereof may or may not covered with a surface layer. The surface layer preferably does not give a large influence on the mechanical characteristics and the melt viscoelastic characteristics of the entire toner. For example, when the toner is covered with a surface layer of a large thickness having a non-melting property or a high melting point, the low temperature fixing property ascribed to the use of the crystalline resin cannot be sufficiently exhibited.

Therefore, the thickness of the surface layer is preferably thin, and specifically, it is preferably in the range of from 0.001 to 0.5 $\mu$m.

In order to form the thin surface layer within the range, such a process is preferably used in that the surface of the particles, which contain the binder resin and the colorant, as well as the inorganic particles and the other materials depending on necessity, is subjected to a chemical treatment.

Examples of components constituting the surface layer include a silane coupling agent, an isocyanate and a vinyl series monomer, and it is preferred that a polar group is introduced thereto, whereby the adhesion force between the toner and the transfer material, such as paper, is increased by chemically bonding.

The polar group may be any functional group having a polarizing property, and examples thereof include a carboxyl group, a carbonyl group, an epoxy group, an ether group, a hydroxyl group, an amino group, an imino group, a cyano group, an amide group, an imide group, an ester group and a sulfone group.

Examples of the process of chemical treatment include a process of oxidizing by a strong oxidative substance, such as a peroxide, ozone oxidation or plasma oxidation, and a process of bonding a polymerizable monomer having the polar group by graft polymerization. The polar group is firmly bonded to the molecular chain of the crystalline resin by covalent bonding a chemical treatment.

In the invention, a substance having a charging property may be attached chemically or physically to the surface of the toner particles. Furthermore, fine particles of a metal, a metallic oxide, a metallic salt, ceramics, a resin or carbon black may be externally added for improving the charging property, the conductivity, the powder fluidity and the lubricating property.

The volume average particle diameter of the electrophotographic toner of the invention is preferably from 1 to 20 $\mu$m, and more preferably from 2 to 8 $\mu$m, and the number average particle diameter thereof is preferably from 1 to 20 $\mu$m, and more preferably from 2 to 8 $\mu$m.

The volume average particle diameter and the number average particle diameter can be measured with a Coulter counter Model TA-II (produced by Coulter Corp.) using an aperture diameter of 50 $\mu$m. At this time, the toner is dispersed in an electrolytic aqueous solution (Isoton aqueous solution) and dispersed with ultrasonic vibration for 30 seconds or more, which is then subjected to the measurement.

Preferred Properties of Electrophotographic Toner of Invention

The electrophotographic toner of the invention is demanded to have a sufficient hardness under ordinary temperature. Specifically, it is preferred that it has, at an angular frequency of 1 rad/sec and a temperature of 30° C., a storage modulus $G_L(30)$ of $1\times10^6$ Pa or more and a loss modulus $G_N(30)$ of $1\times10^6$ Pa or more. The storage modulus $G_L$ and the loss modulus $G_N$ are defined in detail in JIS K-6900.

In the case where the storage modulus $G_L(30)$ is less than $1\times10^6$ Pa, or the loss modulus $G_N(30)$ is less than $1\times10^6$ Pa, at an angular frequency of 1 rad/sec and a temperature of 30° C., there are cases where when the toner is mixed with a carrier in a developing device, the toner particles are deformed by a pressure and a shearing force received from the carrier, and stable charging phenomenon characteristics cannot be maintained. There are also cases where when the toner on the latent image holding member (photoreceptor) is cleaned, it is deformed by a shearing force received from a cleaning blade to cause cleaning failure.

In the case where the storage modulus $G_L(30)$ and the loss modulus $G_N(30)$ at an angular frequency of 1 rad/sec and a temperature of 30° C. are in the ranges, it is preferred since the characteristics on fixing is stable even when it is applied to a high-speed electrophotographic apparatus.

The electrophotographic toner of the invention preferably has a melting point in the range of from 45 to 110° C. Because the crystalline sulfonated polyester suffers sharp drop in viscosity above the melting point, it aggregates to cause blocking when it is stored at a temperature higher than the melting point. Therefore, the melting point of the electrophotographic toner of the invention containing the crystalline sulfonated polyester as the binder resin is preferably a temperature higher than the temperature, to which the toner is exposed upon storage and use, i.e., 45° C. or more. When the melting point is higher than 110° C., on the other hand, it becomes difficult to conduct the low temperature fixing. The electrophotographic toner of the invention is more preferably has a melting point in the range of from 60 to 100° C.

The melting point of the electrophotographic toner of the invention can be obtained as a melt peak temperature of the input compensation differential scanning calorimetry shown in JIS K-7121. While a crystalline resin sometimes shows plural melt peaks, the maximum peak is designated as the melting point in the invention.

The electrophotographic toner of the invention preferably has such a temperature range in that the fluctuation of the storage modulus $G_L$ and the loss modulus $G_N$ depending on the temperature change becomes two or more digits within the temperature range of 10° C. (i.e., such a temperature range in that the values of $G_L$ and $G_N$ is changed to a value of 1/100or less when the temperature is increased by 10° C.).

When the storage modulus $G_L$ and the loss modulus $G_N$ do not have the temperature range, the fixing temperature is increased, and as a result, it becomes insufficient for the fixing at a low temperature, the reduction in energy consumption of the fixing step, and the broad fixing latitude.

When common logarithm of a storage modulus is plotted against a temperature, the electrophotographic toner of the invention preferably satisfies the following formula (1):

$$|\log G_L(Tm+20)-\log G_L(Tm+50)|\leqq 1.5 \quad (1)$$

wherein $G_L$(Tm+20) is a storage modulus at a temperature (Tm+20° C.) higher than a melting point Tm by 20° C., and $G_L$(Tm+50) is a storage modulus at a temperature (Tm+50° C.) higher than a melting point Tm by 50° C., and when common logarithm of a loss modulus is plotted against a temperature, the electrophotographic toner of the invention preferably satisfies the following formula (2):

$$|\log G_N\ (Tm+20)-\log G_N(Tm+50)|\leqq 1.5 \quad (2)$$

wherein $G_N$(Tm+20) is a loss modulus at a temperature (Tm+20° C.) higher than a melting point Tm by 20° C., and $G_N$(Tm+50) is a loss modulus at a temperature (Tm+50° C.) higher than a melting point Tm by 50° C., from the standpoint of obtaining a broad fixing latitude.

The indexes show that the viscosity of the electrophotographic toner of the invention has a moderate dependency on the temperature higher than the melting point, and mean that the temperature dependency of the viscoelasticity becomes lower.

When the value of the left part of the formula (1) exceeds 1.5, the temperature dependency becomes large, and it sometimes insufficient to broaden the fixing latitude, and when the value of the left part of the formula (2) exceeds 1.5, it sometimes insufficient to broaden the fixing latitude.

The electrophotographic toner of the invention preferably has a loss tangent tans at a temperature (Tm+20° C.) higher than a melting point Tm by 20° C. satisfying 0.01<tan δ21 2 at an angular frequency of 1 rad/sec.

When the loss tangent tan δ satisfies the range, excessive penetration into the image carrier, such as paper, can be prevented, and the fixing latitude can be broad, whereby a stable fixed image can be obtained. The loss tangent tans more preferably satisfies 0.01<tanδ<1.5.

FIG. 1 is a graph showing preferred characteristics of the electrophotographic toner of the invention. In FIG. 1, the ordinate indicates the common logarithm of storage modulus $\log G_L$ or the common logarithm of loss modulus $\log G_N$, and the abscissa indicates the temperature. The electrophotographic toner of the invention having such characteristics shows sharp drop in modulus at the melting point in the temperature range of from 45 to 110° C., and the modulus is stabilized in the prescribed range. Therefore, the viscosity is not decreased more than necessity when it suffers a high temperature upon fixing, and thus excessive penetration into the transfer material, such as paper, and occurrence of offset can be prevented.

As described in the foregoing, when the crystalline polyester containing a carboxylic acid of two or more valences having a sulfonic acid group as a copolycondensation component is used as the binder resin of the toner, an electrophotographic toner having good dispersion of a colorant and an excellent low temperature fixing property can be obtained. Furthermore, when the crystalline sulfonated polyester has a crosslinked structure by an unsaturated double bond, an electrophotographic toner can be obtained that has a good offset resisting property and a broad fixing latitude, and satisfies prevention of excessive penetration of the toner into the recording medium, such as paper. Moreover, the particle shape of the toner is made spherical, it becomes possible to improve the transfer efficiency.

Process for producing Electrophotographic Toner

The process for producing an electrophotographic toner of the invention is a process for producing the electrophotographic toner of the invention, in which a crystalline polyester containing a carboxylic acid of two or more valences having a sulfonic acid group as a copolycondensation component is emulsified, and then it is aggregated and unified to adjust a diameter of the toner.

In the step of emulsifying the crystalline polyester having a sulfonic acid group and an unsaturated part, and aggregating along with the colorant, followed by unifying with heat, it is constituted by containing a step of introducing a crosslinked structure by a radical reaction. In the process for producing an electrophotographic toner of the invention, it is preferred, as described in the foregoing, that the crystalline polyester having a sulfonic acid group and preferably an unsaturated double bond, by which a crosslinked structure can be formed, (unsaturated crystalline polyester) is used as the binder resin component, and in the step of emulsifying the unsaturated crystalline polyester having a sulfonic acid group, and aggregating the emulsified particles, followed by unifying with heat to form particles, the crosslinked structure is introduced into the particles by a radical reaction.

Because the crystalline sulfonated polyester is rigid, it is difficult to be pulverized by the conventional melt kneading pulverization process, and the crosslinked product thereof becomes more difficult to be pulverized by adding plasticity by crosslinking. Therefore, such a process is effective that the crystalline sulfonated polyester is emulsified and aggregated along with a pigment, and then after forming particles by unifying with heat, the crosslinked structure is introduced.

As an example of the production process of the electrophotographic toner of the invention, a production process by an emulsion aggregation process (the process for producing an electrophotographic toner of the invention) will be described below. In the following description, the case where a crosslinking type crystalline sulfonated polyester is used as the crystalline sulfonated polyester will be described for example, but in the case where a crystalline sulfonated polyester that is not the crosslinking type is used, the following explanation can be similarly applied except for the description relating to crosslinking.

In the process where the crosslinking type crystalline sulfonated polyester is emulsified, and the emulsified particles are aggregated and unified with heat to form particles, a sulfonated unsaturated crystalline polyester (binder resin) is emulsified and dispersed in an aqueous medium, and the emulsified particles are aggregated and then heated to a temperature more than the melting point of the resin to conduct unification of the aggregates.

That is, the process for producing an electrophotographic toner of the invention contains an emulsifying step of emulsifying a crystalline polyester having a sulfone group part and an unsaturated part as a binder resin, an aggregating step of aggregating the emulsified particles, and a unifying step of unifying the aggregates. The colorant may be previously mixed with the crystalline polyester having a sulfone group part and an unsaturated part before the emulsifying step, or in alternative, may be added along with the emulsified particles in the aggregating step. The crosslinking reaction of the unsaturated part may be conducted in any step. When the reaction is conducted in the production of the emulsified particles, there are case where crosslinking that inhibits the unification of the emulsified particles, and therefore, it is preferred that the crosslinking reaction is conducted during the unification or after the unification. A radical reaction initiator may be added in any step, i.e., before emulsifying, upon emulsifying, upon aggregating or after unifying.

Emulsifying Step

The formation of the emulsified droplets (particles) of the unsaturated crystalline sulfonated polyester is conducted by applying a shearing force to a solution obtained by mixing an aqueous medium with a mixed liquid (polymer liquid) containing the unsaturated crystalline sulfonated polyester and, depending on necessity, a colorant. At this time, by heating or by dissolving the unsaturated crystalline sulfonated polyester in an organic solvent, the viscosity of the polymer liquid can be decreased to form the particles. A dispersant may also be used in order to stabilize the emulsified particles and to increase the viscosity of the aqueous medium. The dispersion of the emulsified particles herein will be sometimes referred to as a "resin particle dispersion" hereinbelow.

Examples of an emulsifier used for emulsification include a homogenizer, a homomixer, a pressure kneader, an extruder and a media disperser. With respect to the size of the emulsified droplets (particles) of the unsaturated crystalline polyester, the average particle diameter thereof is preferably from 0.01 to 1 $\mu$m, and more preferably from 0.03 to 0.3 $\mu$m.

In the invention, examples of a catalyst used in the production of the crosslinking type crystalline sulfonated polyester as the binder resin include an alkali metal compound, such as sodium and lithium compounds, an alkaline earth compound, such as magnesium and calcium compounds, a metallic compound, such as zinc, manganese, antimony, titanium, tin, zirconium and germanium compounds, a phosphorous compound, a phosphoric compound and an amine compound. Specific examples thereof include the following compounds, i.e., sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetraporpoxide, titanium tetraisopropoxide, titanium tetrabtoxide, antimony trioxide, triphenylanitmony, tributylantimony, tin formate, tin oxalate, tetraphenyltin, dibutyltin chloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyltriphenylphosphoniumbromide, triethylamine and triphenylamine.

The heating temperature upon emulsification is selected depending on the emulsified state of the crystalline sulfonated polyester used. When the emulsified state is poor, the temperature is increased. The emulsification can be conducted at from room temperature to 100° C., and is preferably conducted at a temperature in the range of from 60 to 90° C.

Examples of the dispersant used upon emulsification include a water soluble polymer, such as polyvinyl alcohol, methyl cellulose, ethyl cellulose, hydroxyethyl cellulose, carboxymethyl cellulose, polysodium acrylate and polysodium methacrylate, an anionic surfactant, such as sodium dodecylbenzenesulfonate, sodium octadecylsulfate, sodium oleate, sodium laurate and potassium stearate, a cationic surfactant, such as laurylamine acetate, stearylamine acetate and lauryltrimethylammonium chloride, an amphoteric surfactant, such as lauryldimethylamine oxide, a nonionic surfactant, such as polyoxyethylene alkyl ether, polyoxyethylene alkylphenyl ether and polyoxyethylene alkylamine, and an inorganic salt, such as tricalcium phosphate, aluminum hydroxide, calcium sulfate, calcium carbonate and barium carbonate.

In the case where the inorganic compound is used as the dispersant, while a commercial product may be used as it is, such an embodiment may be employed in that fine particles of the inorganic compound are formed in a dispersion medium to obtain fine particles.

The used amount of the dispersant is preferably from 0.01 to 20 parts by weight per 100 parts by weight of the binder resin.

Examples of the solvent, in which the unsaturated crystalline sulfonated polyester and other monomers depending on necessity include an alcohol, such as methanol, ethanol, propanol and butanol, a polyvalent alcohol, such as ethylene glycol, propylene glycol, diethylene glycol and triethylene glycol, a cellosolve, such as methyl cellosolve and ethyl cellosolve, a ketone, such as acetone, methyl ethyl ketone and ethyl acetate, an ether, such as tetrahydrofuran, a hydrocarbon, such as benzene, toluene and hexane, and water. These may be used singly or in combination of two or more of them.

The solvent may be suitably selected depending on the species of the unsaturated crystalline sulfonated polyester and the other monomers added depending on necessity, and the desired particle diameter.

The used amount of the solvent is preferably from 50 to 5,000 parts by weight, and preferably from 120 to 1,000 parts by weight, per 100 parts by weight of the total amount of the unsaturated crystalline sulfonated polyester and the other monomers added depending on necessity.

The colorant may be mixed before the emulsifying step. The colorant that can be used in the toner of the invention has been described hereinabove.

As the method of dispersing the colorant, an arbitrary method, for example, a general dispersing method, such as a rotation shearing type homogenizer, and a ball mill, a sand mill, and a DYENO mill having media, can be used without any limitation.

It is possible that, depending on necessity, an aqueous dispersion of the colorant can be prepared by using a surfactant, and an organic solvent dispersion of the colorant can be prepared by using the dispersant. The dispersion of the colorant will be sometimes referred to as a "colorant dispersion" hereinbelow. As the surfactant and the dispersant used for dispersing, the dispersant used for preparation of the resin particle dispersion may be similarly used.

The addition amount of the colorant is preferably from 1 to 10% by weight, and more preferably from 2 to 7% by weight, based on the total amount of the unsaturated crystalline sulfonated polyester and the other monomers added depending on necessity.

In the case where the colorant is mixed in the emulsifying step, the mixing of the unsaturated crystalline sulfonated polyester and the other monomers added depending on necessity (hereinafter, sometimes simply referred to as a "polymer") with the colorant can be conducted by mixing the colorant or the organic solvent dispersion of the colorant with the organic solvent solution of the polymer.

Aggregating Step

The formation of aggregates of the emulsified particles is conducted by making the pH of the emulsion acidic under stirring. The pH is preferably adjusted in the range of from 2 to 6, and more preferably from 2.5 to 4. It is also effective at this time to use an aggregating agent.

As the aggregating agent used, a surfactant having the opposite polarity to the surfactant used in the resin particle dispersion and the colorant particle dispersion and a metallic complex of two or more valences are preferably used. In particular, the use of the metallic complex is preferred since the used amount of the surfactant can be reduced, and the charging property can be improved.

Examples of the inorganic metallic salt include a metallic salt, such as calcium chloride, calcium nitrate, barium chloride, magnesium chloride, zinc chloride, aluminum chloride and aluminum sulfate, and an inorganic metallic salt polymer, such as polyaluminum chloride, polyaluminum hydroxide and calcium polysulfide. Among these, an aluminum salt and a polymer thereof are preferred. In order to obtain a sharp particle size distribution, the valence number of the inorganic metallic salt is preferably two valences rather than one valence, three valences rather than two valences, and four valences rather than three valences, and in the case of the same valence number, the polymer type inorganic metallic salt polymer is more preferred.

Unifying Step

In the unifying step, the progress of the aggregation is terminated by making the pH of the suspension of the aggregates to the range of from 3 to 7 under stirring similar to the aggregating step, and heating is conducted to a temperature higher than the glass transition point of the polymer to fuse and unify the aggregates.

There is no problem when the heating temperature is higher than the glass transition point of the polymer, and it is preferred that the heating temperature is higher than the glass transition point by 10° C. or more.

The heating time may be such a period that the unification is sufficiently conducted and may be from 0.5 to 10 hours.

The fused particles obtained by fusion can be toner particles through a solid-liquid separation step, such as filtration, and depending on necessity, a washing step and a drying step. In this case, in order to ensure the sufficient charging property and reliability as a toner, it is preferred that they are sufficiently washed in the washing step.

In the drying step, an arbitrary method may be employed, such as an ordinary a vibration type fluidized bed drying method, a spray drying method, a freeze drying method and a flash jet method. It is preferred that the water content of the toner after drying is adjusted to 1.0% or less, and more preferably 0.5% or less.

The crosslinking step is conveniently conducted upon heating to a temperature higher than the melting point in the unifying step or after completion of the unification. In this example, a radical reaction is caused in the unsaturated crystalline sulfonated polyester used as the binder resin to introduce the crosslinked structure. The following polymerization initiator is used at this time.

Examples of the polymerization initiator include t-butylperoxy-2-ethylhexanoate, cumylperpivalate, t-butylperoxylaurate, benzoyl peroxide, lauroyl peroxide, octanoyl peroxide, di-t-butyl peroxide, t-butylcumyl peroxide, dicimyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(t-butylperoxy) hexane, 2,5-dimethyl-2,5-di(benzoylperoxy)hexane, di-t-butylperoxy isophthalate, 2,2-bis(4,4-di-t-butylperoxycyclohexyl)propane, di-t-butylperoxy-α-methylsuccinate, di-t-butylperoxydimethyl glutarate, di-t-butylperoxy hexahydroterephthalate, di-t-butylperoxy azelate, 2,5-dimethyl-2,5-di(t-butylperoxy)hexane, diethylene glycol-bis(t-butylperoxy carbonate), di-t-butylperoxy trimethyladipate, tris(t-butylperoxy)triazine and vinyl tris(t-butylperoxy)silane.

The polymerization initiator may be used singly or in combination of two or more of them. The amount and the species of the polymerization initiator are selected depending on the amount of the unsaturated part in the polymer and the species and the amount of the coexistent colorant.

The polymerization initiator may be previously mixed with the polymer before the emulsifying step or may be incorporated in the aggregates in the aggregating step. Furthermore, it may be introduced during the unifying step or after the unifying step. In the case where it is introduced during the unifying step of after the unifying step, a liquid obtained by dissolving the polymerization initiator in an organic solvent is added to the particle dispersion.

The crosslinked structure introduced by the unsaturated crystalline sulfonated polyester is formed in such a manner that at least one unsaturated part inside the polyester chain is reacted with at least one unsaturated part of the second polyester chain to form a crosslinking unit, which repeatedly occurs (the first mechanism). A huge and high molecular weight molecule is produced by forming the crosslinked structure between the chains to finally form gel.

As the second mechanism, the crosslinked structure is formed by a reaction inside the same polyester chain.

In order to control the polymerization degree, a crosslinking agent, a chain transfer agent and a polymerization inhibitor that have been known may be added.

Electrophotographic Developer

The electrophotographic toner of the invention thus produced can be used as a one-component developer as it is or an electrophotographic developer containing a carrier and a toner (so-called two-component developer).

The electrophotographic developer of the invention, which is an embodiment of the two-component developer, will be described below.

The carrier that can be used in the electrophotographic developer of the invention is not particularly limited, and the known carriers can be used. Examples thereof include a resin coated carrier having a resin coating layer on the surface of a core material. A resin dispersion type carrier containing a matrix resin having an electroconductive material dispersed therein may also be used.

Examples of the coating resin and the matrix resin used in the carrier include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, a vinyl chloride-vinyl acetate copolymer, a styrene-acrylic acid copolymer, a straight silicone resin containing an organosiloxane bond and a modified product thereof, a fluorine resin, polyester, polyurethane, polycarbonate, a phenol resin, an amino resin, a melamine resin, a benzoguanamine resin, a urea resin, an amide resin and an epoxy resin, and they are not limited to these examples.

Examples of the electroconductive material include a metal, such as gold, silver and copper, titanium oxide, zinc oxide, barium sulfate, aluminum borate, potassium titanate, tin oxide and carbon black, and it is not limited to these examples.

Examples of the core material of the carrier include a magnetic metal, such as iron, nickel and cobalt, a magnetic oxide, such as ferrite and magnetite, and glass beads, and the magnetic materials are preferred to apply the carrier to the magnetic brush method.

The volume average particle diameter of the core material of the carrier is generally from 10 to 500 $\mu$m, and preferably from 30 to 100 $\mu$m.

In order to coat the resin on the surface of the core material of the carrier, such a method can be exemplified in that a coating layer forming solution is coated, which contains a suitable solvent having the coating resin and, depending on necessity, various additives dissolved therein. The solvent is not particularly limited and appropriately selected taking the coating resin used and the coating aptitude into consideration.

Specific examples of the method for coating the resin include a dip coating method, in which the core material of the carrier is dipped in the coating layer forming solution, a spray method, in which the coating layer forming solution is sprayed on the surface of the core material of the carrier, a fluidized bed method, in which the coating layer forming solution is sprayed on the core material of the carrier that is suspended by a fluidized air, and a kneader-coater method, in which the core material and the coating layer forming solution are mixed in a kneader-coater, and then the solvent is removed.

The mixing ratio (weight ratio) of the electrophotographic toner of the invention and the carrier (toner/carrier) in the electrophotographic developer of the invention is in the range of about from 1/100 to 30/100, and preferably in the range of about from 3/100 to 20/100.

Process for forming Image

The process for forming an image using the electrophotographic toner of the invention or the electrophotographic developer of the invention will be then described below.

The process for forming an image contains a latent image forming step of forming an electrostatic latent image on a surface of a latent image holding member, a developing step of developing the electrostatic latent image formed on the surface of the latent image holding member with a developer retained on a developer holding member to form a toner image, a transferring step of transferring the toner image formed on the surface of the latent image holding member to a surface of a transfer material, and a fixing step of heat fixing the toner image transferred to the transfer material, in which the electrophotographic toner of the invention or the electrophotographic developer of the invention is used as the developer.

The developer may be either the one-component system or the two-component system. In the case of the one-component system, the electrophotographic toner of the invention is used as it is, and in the case of the two-component system, the electrophotographic developer of the invention is used, which is formed by mixing the electrophotographic toner of the invention and the carrier.

As for the respective steps, any step that has been known in the field of processes for forming an image can be utilized.

For example, an electrophotographic photoreceptor and a dielectric recording material may be used as the latent image carrier.

In the case of the electrophotographic photoreceptor, the surface of the electrophotographic photoreceptor is uniformly charged by a corotron charging device or a contact charging device and then exposed, so as to form an electrostatic latent image (the latent image forming step). It is then made in contact with or closed to a developer roll having a developer layer formed on the surface thereof, so as to attach the toner particles on the electrostatic latent image, whereby a toner image is formed on the electrophotographic photoreceptor (the developing step). The toner image thus formed is transferred to a transfer material, such as paper, by utilizing a corotron charging device (the transferring step). Furthermore, the toner image transferred to the transfer material is heat-fixed by a fixing device to form a final toner image.

Upon heat-fixing by the fixing device, a releasing agent is generally supplied to a fixing member of the fixing device to prevent offset.

When the electrophotographic toner of the invention (including those contained in the electrophotographic developer of the invention, hereinafter the same) is used, an excellent releasing property is exhibited due to the effect of the crosslinked structure in the binder resin, and the used amount of the releasing agent can be reduced, or in alternative, the fixing can be conducted without any releasing agent.

It is preferred that the releasing agent is not used from the standpoint of avoiding the attachment of an oil to the transfer material and the image after fixing. However, when the supplied amount of the releasing agent is 0 mg/cm$^2$, there are cases where the wear amount of the fixing member is increased upon contacting the fixing member to the transfer material, such as paper, during fixing, so as to reduce the durability of the fixing member. Therefore, from the practical standpoint, it is preferred that the releasing agent is supplied to the fixing member at a slight amount in the range of $8.0\times10^{-3}$ mg/cm$^2$.

When the supplied amount of the releasing agent exceeds $8.0\times10^{-3}$ mg/cm$^2$, the image quality is deteriorated due to the releasing agent attached to the surface of the image after fixing, and particularly in the case of using transmitted light, such as an OHP, such a phenomenon may be conspicuously exhibited. Furthermore, the attachment of the releasing agent to the transfer material becomes conspicuous, and sticking may occur. Moreover, the larger the supplied amount of the releasing agent is, the larger the capacity of the tank storing the releasing agent is, and therefore it becomes a factor of growing up of the size of the fixing device.

The releasing agent is not particularly limited, and examples thereof include a liquid releasing agent, such as a dimethyl silicone oil, a fluorine oil, a fluorosilicone oil and a modified oil, such as an amino-modified silicone oil. Among these, from the standpoint of adsorbing on the surface of the fixing member to form a uniform releasing agent layer, a modified oil, such as an amino-modified silicone oil, is preferred since it is excellent in wettability to the fixing member. From the standpoint of forming a uniform releasing agent layer, a fluorine oil and a fluorosilicone oil are preferred.

The use of a fluorine oil or a fluorosilicone oil as a releasing agent in the conventional process for forming an image, which does not use the electrophotographic toner of the invention, is not practical from in terms of cost because the supplied amount of the releasing agent itself cannot be reduced. However, in the case using the electrophotographic toner of the invention, there is no practical problem in terms of cost because the supplied amount of the releasing agent is considerably reduced.

There is no particular limitation on the method for supplying the releasing agent to a surface of a roller or belt, which is the fixing member used in the heat fixing, and examples thereof include a pad method using a pad impregnated with the liquid releasing agent, a web method, a roller method and a non-contact shower method (spray method), and among these, the web method and the roller method are preferred. In these methods, it is advantageous in that the releasing agent can be uniformly supplied, and the supplied amount can be easily controlled. When the releasing agent is uniformly supplied to the entire fixing member by the shower method, it is necessary to additionally use a blade.

The supplied amount of the releasing agent can be measured by the following manner. When ordinary paper used in a general duplicator (typically, J Paper, a trade name, duplicating paper produced by Fuji Xerox Co., Ltd.) is passed through a fixing member having a releasing agent supplied to the surface thereof, the releasing agent is attached to the ordinary paper. The attached releasing agent is extracted by a Soxhlet extractor. Hexane is used as the solvent herein.

The amount of the releasing agent attached to the ordinary paper can be determined by determining the amount of the releasing agent contained in hexane by an atomic absorption spectrophotometric apparatus. The amount thus obtained is designated as the supplied amount of the releasing agent to the fixing member.

Examples of the transfer material (recording material), to which the toner image is transferred, include ordinary paper and an OHP sheet used in a duplicator and a printer of the electrophotographic process.

In order to further improve the smoothness of the surface of the image after fixing, it is preferred that the surface of the transfer material is made smooth as possible, and for example, coated paper formed by coating a resin on a surface of ordinary paper, and art paper for printing can be preferably used.

According to the process for forming an image using the electrophotographic toner of the invention, because the strength of the image after fixing is high, and substantially no releasing agent is attached to the transfer material, it is possible to produce a seal and a sticker having an image of high quality and high density formed thereon by forming the image using a transfer material having adhesiveness on the back surface thereof with a seal or a tape.

The invention will be specifically described with reference to the following examples, but the invention is not construed as being limited to the examples.

EXAMPLE 1

Synthesis of Unsaturated Crystalline Sulfonated Polyester (1)

In a two-neck flask having been dried by heating, an acid component of 5 mol % of dimethyl fumarate, 90 mol % of dimethyl sebacate and 5 mol % of dimethyl isophthalate-5-sodium sulfonate, ethylene glycol (3.5 times by mole of the acid component), and $Ti(OBu)_4$ as a catalyst (0.012% by weight based on the acid component) are charged, and the pressure inside the container is reduced by pressure reduction operation. The interior of the container is made an inert atmosphere with a nitrogen gas, and the contents are refluxed at 180° C. for 5 hours under mechanical stirring. Thereafter, after removing excessive ethylene glycol by distillation under reduced pressure, the temperature is gradually increased to 230° C., followed by stirring for 2 hours. When the content becomes viscous, it is cooled by air to terminate the reaction, so as to obtain a copolymer polyester at a yield of 92%. Reprecipitation purification is conducted by using a THF (tetrahydrofuran)/methanol system to obtain an unsaturated crystalline sulfonated polyester (1).

As a result of confirmation that the unsaturated part and sodium sulfonate group are present in the resulting unsaturated crystalline sulfonated polyester (1) by $^1$H-NMR and IR, the amount of the unsaturated part present in the molecule and the amount of the aromatic skeleton having sodium sulfonate are 5 mol % based on sebacic acid, respectively.

Production of Electrophotographic Toner (1) (Emulsion Aggregation Process)

100 parts by weight of the unsaturated crystalline sulfonated polyester (1) thus obtained and 2.5 parts by weight of lauroyl peroxide are dissolved in 200 parts by weight of tetrahydrofuran, and after adding and dispersing 22.5 parts by weight of a toluene dispersion of copper phthalocyanine of 20% by weight, tetrahydrofuran is removed at 25° C. to produce 107 parts by weight of a resin having the pigment and the polymerization initiator dispersed therein.

107 parts by weight of the resin having the pigment and the polymerization initiator dispersed therein is put in 2,000 parts by weight of water heated to 80° C. under a nitrogen stream, and emulsified by applying a shearing force for 20 minutes in an ULTRATURRAX™ stirrer at 8,000 rpm. After cooling to 25° C., the pH is adjusted to 2.0 by using 2N nitric acid, 0.2 part of polyaluminum chloride is added thereto, which is stirred at room temperature. After increasing the temperature to 50° C. with continuous stirring, pH is adjusted to 7.0, and it is stirred at 75° C. for 2 hours to proceed the reaction.

After cooling to room temperature, it is washed with distilled water, followed by drying, so as to obtain 90 parts by weight of the electrophotographic toner (1) of the invention.

The electrophotographic toner (1) is measured with a Coulter counter Model TA-II (produced by Coulter Corp., aperture diameter: 50 $\mu$m), and it is found that the volume average particle diameter is 3.5 $\mu$m, and the number average particle diameter is 2.5 $\mu$m.

When the electrophotographic toner (1) is added to tetrahydrofuran, the electrophotographic toner (1) remains but is not dissolved. In general, a crystalline polyester is easily dissolved in the solvent, and thus it is considered that the crosslinked structure is formed in the electrophotographic toner (1).

EXAMPLE 2

100 parts by weight of the unsaturated crystalline sulfonated polyester (1) obtained in Example 1 and 2.5 parts by weight of lauroyl peroxide are dissolved in 200 parts by weight of tetrahydrofuran, and tetrahydrofuran is removed at 25° C. to produce 102.5 parts by weight of a resin having the polymerization initiator dispersed therein.

102.5 parts by weight of the resin having the polymerization initiator dispersed therein is put in 2,000 parts by weight of water heated to 80° C. under a nitrogen stream, and emulsified by applying a shearing force for 20 minutes in an ULTRATURRAX™ stirrer at 8,000 rpm. After cooling to 25° C., the pH is adjusted to 2.0 by using 2N nitric acid, 22.5 parts by weight of an aqueous dispersion having 4.5 parts by weight of copper phthalocyanine dispersed therein and 0.2 part of polyaluminum chloride are added thereto, which is stirred at room temperature. After increasing the temperature to 50° C. with continuous stirring, pH is adjusted to 7.0, and it is stirred at 75° C. for 2 hours to proceed the reaction.

After cooling to room temperature, it is washed with distilled water, followed by drying, so as to obtain 92 parts by weight of the electrophotographic toner (2) of the invention.

The electrophotographic toner (2) is measured in the same manner as in Example 1, and it is found that the volume average particle diameter is 4.8 μm, and the number average particle diameter is 2.3 μm.

EXAMPLE 3

100 parts by weight of the unsaturated crystalline sulfonated polyester (1) obtained in Example 1 is added to 1,900 parts by weight of ion exchanged water and emulsified by applying a shearing force for 10 minutes at 80° C. and 10,000 rpm in an ULTRATURRAX™ stirrer to obtain a dispersion.

After cooling 250 parts by weight of the dispersion to 25° C., 2.7 parts by weight of a copper phthalocyanine aqueous solution of 25% by weight is added thereto under a nitrogen stream, and the pH is adjusted to 2.0 by using 2N nitric acid. 0.26 part by weight of polyaluminum chloride (aqueous solution of 10% by weight) and 3.3 parts by weight of an ethyl acetate solution of lauroyl peroxide of 18% by weight are added thereto, followed by stirring at room temperature. The temperature is gradually increased with continuous stirring, and after increasing the temperature to 50° C., the pH is adjusted to 7.0, and it is stirred at 75° C. for 3 hours to proceed the reaction.

After cooling to room temperature, it is washed with distilled water, followed by drying, so as to obtain 11.75 parts by weight of the electrophotographic toner (3) of the invention.

The electrophotographic toner (3) is measured in the same manner as in Example 1, and it is found that the volume average particle diameter is 3.6 μm, and the number average particle diameter is 2.5 μm.

COMPARATIVE EXAMPLE 1

Synthesis of Crystalline Polyester (2) having Unsaturated Bond

In a two-neck flask having been dried by heating, an acid component of 10 mol % of dimethyl fumarate and 90 mol % of dimethyl sebacate, ethylene glycol (3.5 times by mole of the acid component), and $Ti(OBu)_4$ as a catalyst (0.01% by weight based on the acid component) are charged, and the pressure inside the container is reduced by pressure reduction operation. The interior of the container is made an inert atmosphere with a nitrogen gas, and the contents are refluxed at 180° C. for 5 hours under mechanical stirring. Thereafter, after removing excessive ethylene glycol by distillation under reduced pressure, the temperature is gradually increased to 230° C., followed by stirring for 2 hours. When the content becomes viscous, it is cooled by air to terminate the reaction. Before the content is solidified, THF is added into the reaction container, and the residual catalyst is removed by a pressure filtration apparatus.

Purification is conducted by recovering a re-precipitation product from a THF/methanol system, and drying is conducted under reduced pressure to obtain a crystalline polyester (2) having an unsaturated bond is obtained at an yield of 73%.

As a result of confirmation that the unsaturated part is present in the resulting crystalline polyester (2) by $^1$H-NMR and IR, the amount of the unsaturated part present in the molecule is 10 mol % based on sebacic acid. No sodium sulfonate group is present in the crystalline polyester (2).

Production of Electrophotographic Toner (4) (Suspension Polymerization Process)

75 parts by weight of the thus resulting crystalline polyester (2) having an unsaturated bond and 3.4 parts by weight of copper phthalocyanine pigment (C.I. Pigment Blue 15:3) are mixed with 75 parts by weight of ethyl acetate, and dispersed in a sand mill to prepare a dispersion.

20 parts by weight of calcium carbonate is added to 300 parts by weight of a carboxymethyl cellulose aqueous solution of 1.0% by weight, and then nitrogen bubbling is conducted. 100 parts by weight of the dispersion obtained in the foregoing is added thereto at 50° C. and stirred for 3 minutes at 50° C. at 10,000 rpm in an ULTRATURRAX™ stirrer to obtain a suspension solution. While continuing heating and stirring under a nitrogen stream, a solution obtained by dissolving 1.5 parts by weight of 2,2'-azobisisobutyronitrile (polymerization initiator) in 22 parts by weight of toluene is added to the suspension solution, and it is reacted at 80° C. for 1.0 hour. Under continued stirring, the suspension solution is cooled to 40° C. over a water bath to terminate the suspension polymerization, so as to obtain a crosslinked particle dispersion. Water in an amount of about 5 times the amount the crosslinked particle dispersion is added thereto, and after dissolving the calcium carbonate with hydrochloric acid, water washing is repeated to obtain a mixture of water and a toner. Finally, water is evaporated to obtain an electrophotographic toner (4) of a comparative example.

The electrophotographic toner (4) is measured in the same manner as in Example 1, and it is found that the volume average particle diameter is 6.5 μm, and the number average particle diameter is 6.1 μm.

COMPARATIVE EXAMPLE 2

Synthesis of Amorphous Polyester

In a flask having been dried by heating, 100 parts by mole of an acid component of 80 mol % of terephthalic acid, 10 mol % of n-dodecenyl succinic acid and 10 mol % of trimellitic acid, 35 parts by mole of polyoxyethylene-(2,0)-2,2-bis(4-hydroxyphenyl)propane, 65 parts by mole of polyoxyethylene(2,2)-2,2-bis(4-hydroxyphenyl)propane and 0.05 mol % of dibutyltin oxide based on the acid component are charged, and after introducing a nitrogen gas into the container to maintain an inert atmosphere and increasing the temperature, a copolycondensation reaction is conducted at from 150 to 230° C. for about 12 hours, and then the pressure is gradually reduced at from 210 to 250° C., so as to synthesize an amorphous polyester.

Production of Electrophotographic Toner (5)

86 parts by weight of the amorphous polyester and 16 parts by weight of a copper phthalocyanine pigment (C.I. Pigment Blue 15:3) are melt-kneaded by using a Banbury mixer, so as to obtain a colored resin composition having a high color density. 25 parts by weight of the colored resin composition and 75 parts by weight of the amorphous polyester are dispersed and dissolved in 100 parts by weight of ethyl acetate to prepare a dispersion solution.

200 parts by weight of the resulting dispersion solution is put in a mixed liquid of 1 part by weight of carboxymethyl cellulose, 20 parts by weight of calcium carbonate and 100 parts by weight of water, and they are subjected to high-speed stirring for dispersing by using the mixer, so as to obtain an emulsified liquid. The emulsified liquid is placed in a beaker and maintained at 45° C. for 10 hours under stirring, whereby the ethyl acetate is evaporated. The calcium carbonate is dissolved with hydrochloric acid, and water washing is repeated, so as to obtain a mixture of water and a toner. Finally, water is evaporated at 45° C. in a vacuum dryer to obtain an electrophotographic toner (5).

The electrophotographic toner (5) is measured in the same manner as in Example 1, and it is found that the volume average particle diameter is 7.9 μm, and the number average particle diameter is 7.3 μm.

Evaluation of Properties

2RHIOS System Ver. 4.3.2, produced by Rheometric Scientific FE Co., Ltd.).

The measurement is conducted, after the electrophotographic toner to be measured is set in a sample holder, at a temperature increasing rate of 1° C. per minute, a frequency of 1 rad/sec, a distortion of 20% or less and a detection torque within the range of the measurement compensation value. Sample holders of 8 mm and 20 mm are switched depending on necessity.

What are specifically measured are a storage modulus $G_L(30)$ and a loss modulus $G_N(30)$ at 30° C., and changes of the storage modulus $G_L$ and the loss modulus $G_N$ depending on the change of the temperature. By using the resulting changes of the storage modulus $G_L$ (Pa) and the loss modulus $G_N$ (Pa) depending on the temperature change, the value of $|\log G_L(Tm+20)-\log G_L(Tm+50)|$ (the left part of the formula (1)) and the value of $|\log G_N(Tm+20)-\log G_N(Tm+50)|$ (the left part of the formula (2)) are calculated.

At the same time, tanδ(Tm+20) is also obtained. Furthermore, by using the resulting changes of the storage modulus $G_L$ (Pa) and the loss modulus $G_N$ (Pa) depending on the temperature change, it is determined as to whether or not the temperature range is present in that the fluctuation of the storage modulus $G_L$ and the loss modulus $G_N$ depending on the temperature change becomes two or more digits within the temperature range of 10° C. (hereinafter sometimes simply referred to as a "temperature range with fluctuation of two or more digits"). The results are shown in Table 1 below

TABLE 1

(Evaluation of Properties)

| | Example 1 | Example 2 | Example 3 | Comparative Example 1 | Comparative Example 2 |
|---|---|---|---|---|---|
| Kind of electrophotographic toner | (1) | (2) | (3) | (4) | (5) |
| Volume average particle diameter (μm) | 3.5 | 4.8 | 3.6 | 6.5 | 7.9 |
| Number average particle diameter (μm) | 2.5 | 2.5 | 2.5 | 6.1 | 7.3 |
| Melting point Tm (° C.) | 68 | 68 | 68 | 70 | 66 (Tg) |
| Storage modulus $G_L(30)$ (Pa) | $4.2 \times 10^7$ | $4.5 \times 10^7$ | $2.1 \times 10^7$ | $3.2 \times 10^8$ | $1.0 \times 10^9$ |
| Loss modulus $G_N(30)$ (Pa) | $4.7 \times 10^6$ | $5.2 \times 10^6$ | $4.9 \times 10^6$ | $7.2 \times 10^7$ | $3.4 \times 10^7$ |
| $\lvert\log G_L(Tm + 20) - \log G_L(Tm + 50)\rvert$ | 0.02 | 0.004 | 0.004 | 0.01 | 2.3 |
| $\lvert\log G_N(Tm + 20) - \log G_N(Tm + 50)\rvert$ | 0.04 | 0.002 | 0.005 | 0.18 | 3.1 |
| Tanδ(Tm + 20) | 0.59 | 0.65 | 0.32 | 0.40 | 2.24 |
| Presence of temperature range with fluctuation of two or more digits | yes | yes | yes | yes | no |

Measurement of Melting Point

The melting points (Tm) of the electrophotographic toners obtained in Examples 1 to 3 and Comparative Examples 1 and 2 are measured by thermal analysis device of a differential scanning calorimeter (DSC 3110, Thermal Analysis System 001, produced by MAC Science Co., Ltd.) (hereinafter abbreviated as "DSC"). The measurement is conducted at a temperature increasing rate of 10° C. per minute from room temperature to 150° C., and the melting point is obtained by analyzing according to the JIS Standard (cf. JIS K-7121). The results of the measurement are summarized in Table 1 below. With respect to the electrophotographic toner of Comparative Example 2, no clear melting point is observed, and therefore the glass transition point (Tg) is indicated.

Measurement of Viscoelasticity

The viscoelasticity of the electrophotographic toners of Examples 1 to 3 and Comparative Examples 1 and 2 is measured by using a rotation plate type rheometer (RDA It is understood from the results shown in Table 1 that the electrophotographic toners (1) to (3) of the invention satisfy the conditions of the graph shown in FIG. 1 and have suitable viscoelasticity. On the other hand, the electrophotographic toner (5) using the amorphous polyester having no sulfonic acid group nor crosslinked structure as the binder resin suffers no sharp drop in viscoelasticity depending on the temperature within the temperature range of from the glass transition point to the temperature higher by 50° C., and even when the temperature is further increased, the change of the viscoelasticity depending on the temperature does not become small as shown in FIG. 1. Since the electrophotographic toner (4) has the crosslinked structure, it exhibits certainly good viscoelasticity.

Evaluation of Performance

Fixing Performance

Image formation is conducted by using the electrophotographic toners obtained in Examples 1 to 3 and Comparative Examples 1 and 2 with carrier of A Color in a full color duplicator A Color (produced by Fuji Xerox Co., Ltd.), the fixing device of which is modified (whereby the fixing temperature can be freely set, and the supply of the fixing oil can be controlled), so as to evaluate the fixing performance of the electrophotographic toners. The mixing ratio (weight ratio) of the toner and the carrier (toner/carrier) is 5/100.

The evaluation of the fixing performance is conducted in the following manner. The fixing temperature is increased from 80° C. to 200° C. with a step of 10° C., and the lowest temperature where the toner can be fixed (the lowest fixing temperature) and the lowest temperature where the toner is transferred to a roll of the fixing device, i.e., the offset phenomenon occurs, (the offset initiation temperature) are obtained.

The test conditions of the fixing performance are shown below. The results of the test of the fixing performance are summarized in Table 2 below.

Test Conditions

Toner image: solid image (40 mm×50 mm)

Toner amount: 0.9 mg/cm$^2$

Paper (transfer material): Paper for color duplication (J Paper) produced by Fuji Xerox Co., Ltd.

Transporting rate: 160 mm/sec for paper

Fixing oil (releasing agent): silicone oil, coated amount: $1.6\times10^{-3}$ mg/cm$^2$ Dispersibility of Colorant The cross sections of the electrophotographic toners obtained in Examples 1 to 3 and Comparative Examples 1 and 2 are observed and evaluated with a transmission electron microscope. The evaluation standard is as follows.

A: The particles of the colorant are uniformly dispersed in the particles of the toner.

B: A large aggregate of the colorant is observed in the particles of the toner, and it cannot be practically used.

TABLE 2

(Evaluation of Performance)

| | Example 1 | Example 2 | Example 3 | Comparative Example 1 | Comparative Example 2 |
|---|---|---|---|---|---|
| Fixing performance | | | | | |
| Lowest fixing temperature (° C.) | 100 | 100 | 100 | 110 | 120 |
| Offset initiation temperature (° C.) | 200< | 200< | 200< | 200< | 170 |
| Dispersibility of colorant | A | A | A | B | A |

It is understood from the results shown in Table 2 that the electrophotographic toners (1) to (3) of the invention can be fixed at a lower temperature than the electrophotographic toner (5) using the amorphous linear polyester as the binder resin, and they do not cause offset at 200° C. or higher and have a broad fixing latitude.

On the other hand, the electrophotographic toner (5) using the polyester having no crosslinked structure as the binder resin cannot have sufficient performance as a toner for low temperature fixing.

As a result of observation of the cross sections of the electrophotographic toners (1) to (3) of the invention, the dispersibility of the colorant is good in comparison to the electrophotographic toner (4) produced by the suspension polymerization process.

As described in the foregoing, according to the invention using the crystalline polyester containing a carboxylic acid of two or more valences having a sulfonic acid group as a copolymerization component as a binder resin, an electrophotographic toner excellent in dispersibility of a colorant (excellent in coloring property) and also excellent in fixing property at a low temperature can be provided.

When the crystalline polyester is crosslinked by a chemical bond, an electrophotographic toner having a good offset resisting property and a broad fixing latitude can be provided.

Furthermore, according to the invention, a process for producing an electrophotographic toner having the foregoing excellent characteristics, particularly an electrophotographic toner having a spherical shape, can be provided.

Moreover, according to the invention, an electrophotographic developer and a process for forming an image using the electrophotographic toner having the foregoing excellent characteristics can be provided.

The entire disclosure of Japanese Patent Application No. 2000-119154 filed on Apr. 20, 2000 including specification, claims, drawings and abstract is incorporated herein by reference in its entirety.

What is claimed is:

1. An electrophotographic toner comprising a binder resin and a colorant, the binder resin containing a crystalline polyester containing a carboxylic acid of two or more valences having a sulfonic acid group as a monomer component.

2. An electrophotographic toner as claimed in claim 1, wherein the crystalline polyester is a crosslinked crystalline resin.

3. An electrophotographic toner as claimed in claim 1, wherein the crystalline polyester has a melting point of from 45 to 110° C.

4. An electrophotographic toner as claimed in claim 1, wherein the toner has, at an angular frequency of 1 rad/sec and a temperature of 30° C., a storage modulus $G_L(30)$ of $1\times10^6$ Pa or more and a loss modulus $G_N(30)$ of $1\times10^6$ Pa or more.

5. An electrophotographic toner as claimed in claim 1, wherein when common logarithm of a storage modulus is plotted against a temperature, the electrophotographic toner satisfies the following formula (1):

$$|\log G_L(Tm+20)-\log G_L(Tm+50)|\leqq 1.5 \quad (1)$$

wherein $G_L(Tm+20)$ is a storage modulus at a temperature (Tm+20° C.) higher than a melting point Tm by 20° C., and $G_L(Tm+50)$ is a storage modulus at a temperature (Tm+50° C.) higher than a melting point Tm by 50° C., and when common logarithm of a loss modulus is plotted against a temperature, the electrophotographic toner satisfies the following formula (2):

$$|\log G_N(Tm+20)-\log G_N(Tm+50)|\leqq 1.5 \quad (2)$$

wherein $G_N$(Tm+20) is a loss modulus at a temperature (Tm+20° C.) higher than a melting point Tm by 20° C., and $G_N$(Tm+50) is a loss modulus at a temperature (Tm+50° C.) higher than a melting point Tm by 50° C.

6. An electrophotographic toner as claimed in claim 1, wherein the carboxylic acid component of two or more valence having sulfonic acid is contained in an amount of from 1 to 15 mol % based on the total carboxylic acid component constituting the polyester.

7. An electrophotographic toner as claimed in claim 1, wherein the carboxylic acid of two valences having a sulfonic acid group is one having the structure represented by the following general formula (I):

$$A(SO_3^-X^+)_nZ_2 \quad (I)$$

wherein A represents a hydrocarbon atomic group having a linear form, a branched form, a cyclic form or a mixed form thereof, X represents a monovalent cation or a multivalent cation, each Z represents a carboxyl group or each Z represents an alkyl ester formed by esterifying a carboxyl group or both Z's represent carboxyl groups dehydrated to form a cyclic anhydride, and n represents an integer of from 1 to 3.

8. An electrophotographic toner as claimed in claim 7, wherein each Z in the general formula (I) is an alkyl ester formed by esterifying a carboxyl group, or both Z's represent carboxyl groups dehydrated to form a cyclic anhydride.

9. An electrophotographic toner as claimed in claim 7, wherein the hydrocarbon atomic group represented by A in the general formula (I) is an arylene group having from 6 to 24 carbon atoms or a linear or a branched alkylene group having from 1 to 20 carbon atoms.

10. An electrophotographic toner according to claim 7, wherein X is a monovalent cation is selected from the group consisting of $H^+$, $Na^+$, $K^+$and Li.

11. An electrophotographic toner according to claim 7, wherein X is a multivalent cation selected from the group consisting of $Mg^{2+}$, $Ca^{2+}$, $Sr^{2+}$, $Ba^{2+}$, Fe cation, Co cation, Ni cation, Cu cation, Zn cation, and Al cation.

12. An electrophotographic toner as claimed in claim 1, wherein the toner has a loss tangent tanδ at a temperature (Tm+20° C.) higher than a melting point Tm by 20° C. satisfying $0.01<\tan\delta<2$ at an angular frequency of 1 rad/sec.

13. An electrophotographic developer comprising a carrier and a toner, the toner being the electrophotographic toner as claimed in claim 1.

14. An electrophotographic developer as claimed in claim 13, wherein the carrier has a resin coating layer.

15. An electrophotographic developer as claimed in claim 13, wherein a weight ratio of the toner and the carrier is from about 3/100 to about 20/100.

16. A process for producing an electrophotographic toner, comprising:

emulsifying a crystalline polyester containing a carboxylic acid of two or more valences containing a sulfonic acid group as a monomer component; and aggregating and unifying the same to adjust a diameter of the toner.

17. A process for producing an electrophotographic toner as claimed in claim 16, wherein the process further comprises a step of introducing a crosslinked structure by a radical reaction.

18. A process for forming an image, comprising:

forming an electrostatic latent image on a surface of a latent image holding member;

developing the electrostatic latent image formed on the surface of the latent image holding member with a developer retained on a developer holding member to form a toner image;

transferring the toner image formed on the surface of the latent image holding member to a surface of a transfer material; and heat-fixing the toner image transferred to the transfer material, the developer comprising the electrophotographic toner as claimed in claim 1.

* * * * *